United States Patent [19]

Gee

[11] 4,114,408

[45] Sep. 19, 1978

[54] GATE LOCK AND LATCH

[76] Inventor: Victor L. Gee, 1511-12th St. W., Billings, Mont. 59102

[21] Appl. No.: 784,170

[22] Filed: Apr. 4, 1977

[51] Int. Cl.[2] ..... E05C 5/02; E05B 37/12

[52] U.S. Cl. ..... 70/128; 70/133; 70/288; 70/312; 70/316; 70/319; 292/57

[58] Field of Search ..... 70/22, 23, 24, 25, 26, 70/115, 117, 119, 122, 126, 128, 133, 287, 288, 312, 315, 316, 317, 318, 319; 292/57, 59

[56] References Cited

U.S. PATENT DOCUMENTS

| | | | |
|---|---|---|---|
| 622,676 | 4/1899 | Forney | 292/57 |
| 661,560 | 11/1900 | Stall | 70/288 X |
| 802,062 | 10/1905 | Vieweg | 70/312 |
| 1,021,456 | 2/1912 | Evans | 70/30 X |
| 1,294,462 | 2/1919 | Herlhy | 292/57 |
| 1,325,641 | 12/1919 | Kish | 70/312 |
| 1,410,033 | 3/1922 | Pass | 70/316 X |
| 1,445,719 | 2/1923 | Rozycki | 70/287 X |
| 1,472,206 | 10/1923 | Burkle | 70/30 |
| 1,497,793 | 6/1924 | Saunders et al. | 70/312 |
| 1,527,727 | 2/1925 | Zweiman | 70/25 |
| 1,546,333 | 7/1925 | Wortman | 70/25 |
| 1,593,684 | 7/1926 | Anakin | 292/57 X |
| 1,597,642 | 8/1926 | Warne | 70/25 X |
| 1,724,759 | 8/1929 | Gravel | 292/57 |
| 1,777,093 | 3/1916 | Evans | 70/30 |
| 2,166,059 | 7/1939 | Kirk | 70/339 |
| 2,640,344 | 6/1953 | Margo | 70/133 |
| 3,115,762 | 12/1963 | Nemsky | 70/287 X |
| 3,410,121 | 11/1968 | Morin | 70/25 |
| 3,851,507 | 12/1974 | Gehrie | 70/312 X |
| 3,910,078 | 10/1975 | Schulz | 70/30 |

FOREIGN PATENT DOCUMENTS

| | | | |
|---|---|---|---|
| 372,613 | 3/1923 | Fed. Rep. of Germany | 70/119 |
| 186,524 | 10/1922 | United Kingdom | 70/25 |
| 18,757 of | 1914 | United Kingdom | 70/319 |

*Primary Examiner*—Thomas J. Holko

*Attorney, Agent, or Firm*—Merchant, Gould, Smith, Edell, Welter & Schmidt

[57] ABSTRACT

A lock comprising a bolt slidable into an operative position and from there rotatable into a locked position in which pins projecting from the bolt prevent it from sliding: locking members are rotatable about axes orthogonal to the axis of the bolt into positions where they interfere with rotation of the pins, and prevent the bolt from being rotated out of the locked position, unless the locking members are properly positioned about their axes.

4 Claims, 6 Drawing Figures

GATE LOCK AND LATCH

BACKGROUND OF THE INVENTION

This invention relates to the field of security closures, and specifically to combination locks specially designed for use within closures of relatively large size and weight.

A need exists for securing entrance closures in fences, warehouses and so forth where the openings are of vehicular size, and the doors and gates must be similarly proportioned. Heavy hinges and similar hardware are at hand, but heretofore no locks of adequate size and strength have been available. Occasion also arises for locking closures at unattended or intermittently attended locations where it is advantageous to install a lock capable of resisting all but the most extreme applications of unauthorized force.

SUMMARY OF THE INVENTION

The invention comprises a lock having a bolt slidable and rotatable in a housing in response to manual manipulation of a knob outside the housing. In the operative condition of the lock the bolt is slid to an extreme position, so that one end of the bolt extends well beyond the housing for reception in a suitable strike member not a part of the invention. A plurality of pins extend radially from the bolt at predetermined axial locations therealong. When in its operative position linearly, the bolt may be rotated into a locked position, where linear movement is prevented by the pins. Control means including a plurality of locking members forms a part of the housing, and the locking members are rotatable, about axes orthogonal to the axis of the bolt, into the space moved through by the pins when the bolt is rotated into or out of the locked position, to prevent such rotation of the bolt. Each locking member is settable from outside the housing to a plurality of positions, in one of which the member is configured to enable passage of the associated pin, so that the array of locking members acts as a combination lock to prevent rotation of the bolt. Means are disclosed for altering the "combination" of the lock so constructed.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
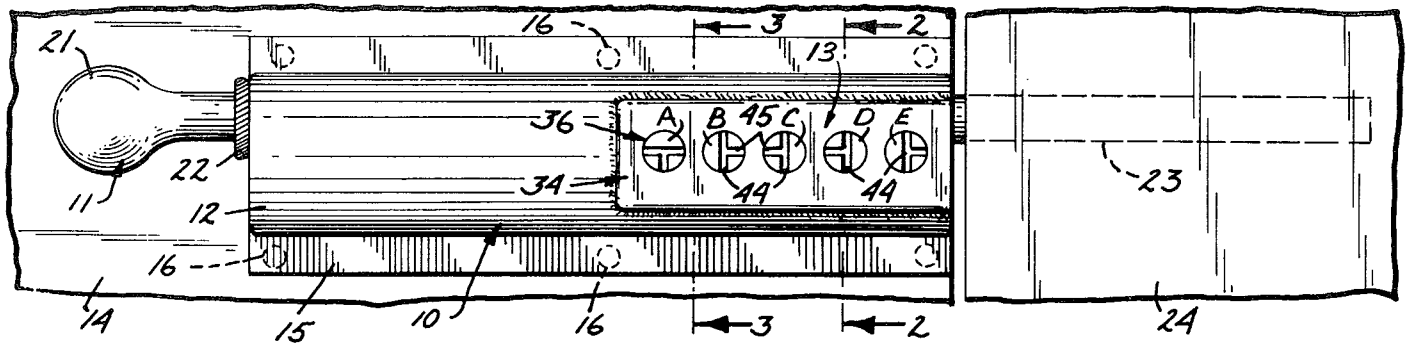
FIG. 1 is a perspective view of a lock embodying the invention.

As shown in the drawing, my lock comprises a housing 10 and a bolt 11. Housing 10 consists of a casing 12, here shown as a hollow cylinder having a portion cut away to receive a control unit 13 incorporated therein as by welding. Casing 12 may in turn be welded to the closure member 14 to be secured, or to a base plate 15 for attachment to the closure member by fasteners 16 passing through or secured to base plate 15. Bolt 11 passes through aligned apertures in a pair of end closures 17 and 20, and is rotatable and slidable by means of a manual knob 21 at one end. A stop ring 22 is secured to bolt 11, and when it engages closure 20 it defines an operative position of the bolt, in which its opposite end 23 extends well beyond closure 17 to engage a suitable strike member 24.

A plurality of pins 25 extend transversely from bolt 11 within casing 12 to lie on a common plane. A latching plate 26 is positioned in casing 12 and is provided with apertures 27 aligned with the axial locations of the pins when the bolt is in its operative position. Each aperture comprises a cylindrical hole 30 from which there extends, in a direction orthogonal to and generally toward the bolt, a slot 31 slightly larger and wider than the diameter of pin 25. It will be clear that when the bolt is in its operative position linearly, it can be rotated so that pins 25 enter into and engage the ends of slots 31, limiting the rotation of the bolt and defining for it a locking position in which the walls of slots 31 engage pins 25 to prevent sliding of the bolt in either direction.

Figure 3:
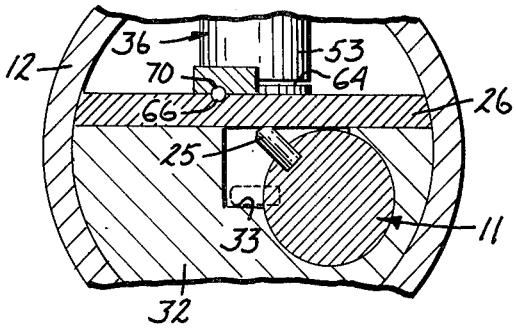
FIG. 3 is a fragmentary view like FIG. 2 but taken along the line 3—3 of FIG. 1.

As shown in FIG. 3, means is provided for limiting the rotation of bolt 11, Clockwise rotation is prevented by plate 26, except when bores 30 and slots 31 are in alignment with the pins, and a member 32 is provided to limit bolt rotation in the opposite sense at a shoulder 33. Plate 26 and shoulder 33 may if desired continue the full length of the casing.

Movement of the bolt to the left in FIG. 1 is limited by engagement of one of pins 25 with the inner surface of closure 20.

Figure 4:
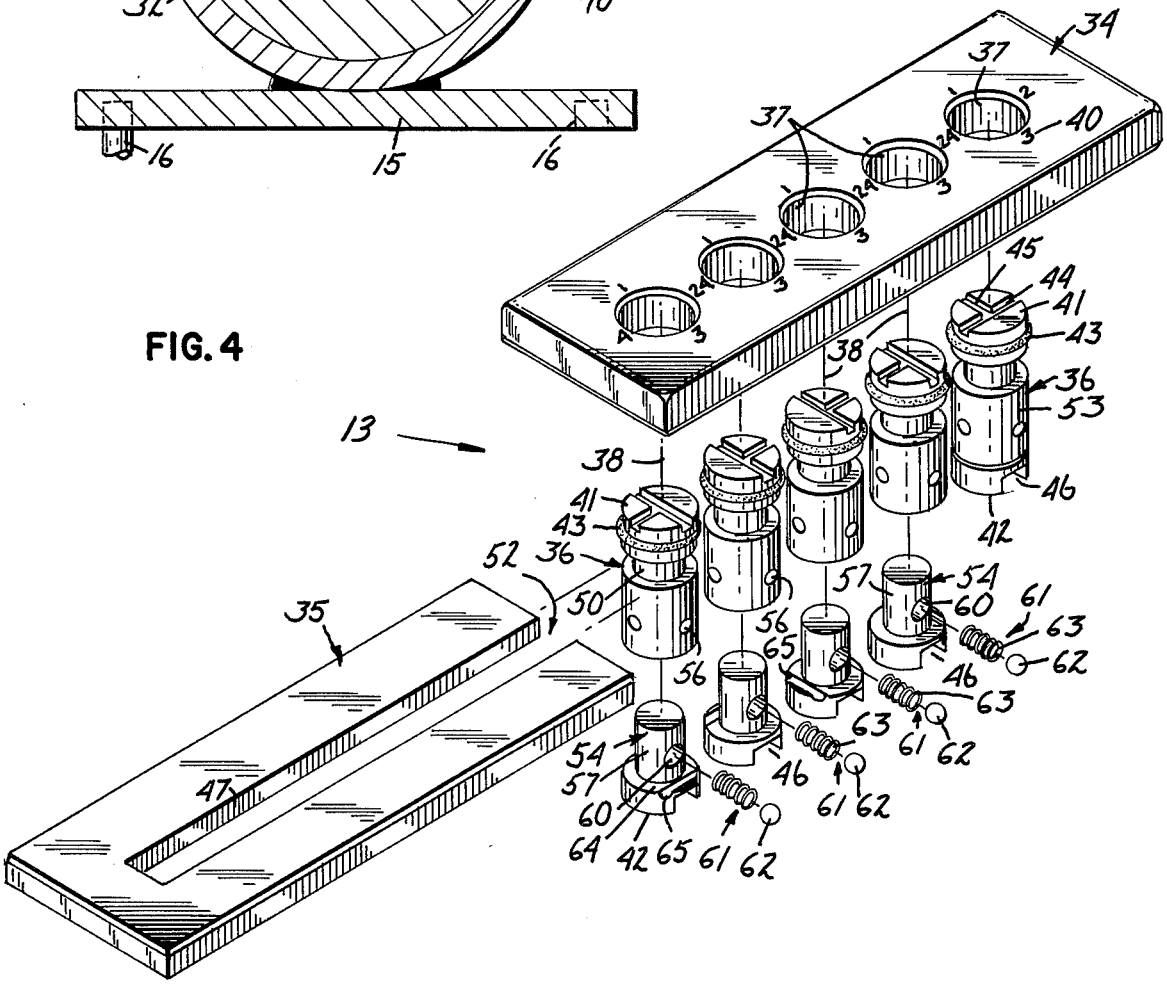
FIG. 4 is an exploded view of the control means and its locking members.

Control unit 13 is shown in FIG. 4 to comprise a mounting plate 34, a holding member 35, and a plurality of generally cylindrical locking members 36. Plate 34 is provided with a plurality of cylindrical bores 37 having their axes 38 parallel and lying in a common plane in which they have the same spacing as that of pins 25 along bolt 11. Indicia 40 are marked at ninety degree intervals around the circumferences of bores 37.

Each of locking members 36 has an outer end 41 and an inner end 42. Outer end 41 is a smooth rotating fit in the associated aperture 37, sealing being accomplished by an O-ring 43. A pair of slots 44 and 45 configured as a T are formed in the face of end 41 for receiving a coin or the blade of a screwdriver or other tool when it is desired to rotate the member in the plate. A ramp 46 is cut radially in the face of inner end 42 of member 36 for a purpose presently to be described.

Holding member 35 is of generally the same outline as plate 34, and has a straight central slot 47. Intermediate between ends 41 and 42 of each locking member is a groove 50 having a width equal to the thickness of member 35 and a depth sufficient to fit comfortably in slot 47. It will be appreciated that when members 36 are inserted into bores 37, and member 35 is slid therealong to engage the grooves 50 and is then secured to plate 34, members 30 are free to rotate in apertures 37, but are prevented from movement in the directions of their axes with respect thereto.

The control unit forms a portion of the wall of housing 10, casing 12 being cut away as at 51 to permit this. The unit is positioned on the casing so that axes 38 are orthogonal to the axis of bolt 11 and are longitudinally aligned with pins 25 in the operative position of the bolt. Under these conditions the inner ends 42 of the locking members are rotatably received in apertures 30 of plate 26. Assembly of the entire lock is completed by welding member 35 to casing 12 and welding plate 34 to member 35, at the same time suitably closing the open end 52 of slot 47.

Figure 5:
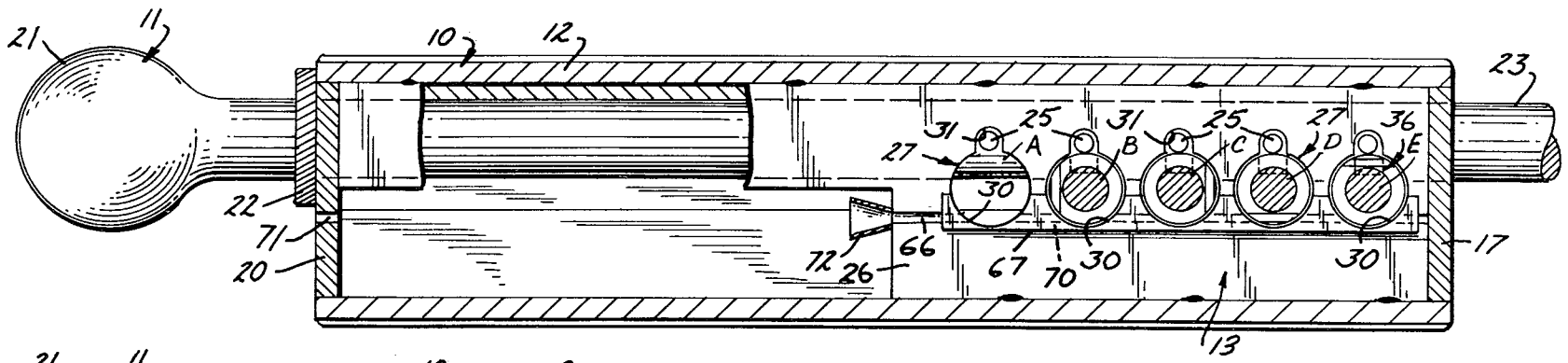
FIG. 5 is a longitudinal section of the lock taken as indicated by the line 5—5 of FIG. 2, with parts removed for clarity of illustration.

For each locking member the position of ramp 46 with respect to slot 45, angularly about axis 38, is known. Four such relations are available: they may be the same, opposite, or at ninety degrees in either direction. It will be apparent that by properly rotating members 36 they can be positioned so that all the ramps are directed toward the associated pins 25 at the same time. There is then nothing to prevent the pins from being rotated into or out of the locking position of bolt 11. This situation is illustrated in FIG. 5. However, if any of the locking members is rotated to a different position, its end moves into the volume of space traversed by the associated pin, and rotation of the bolt into or out of the locking position is impossible.

Since there are five locking members and each has four possible positions, the number of settings possible is four to the fifth power, or 1024. In this elementary form of the invention the user turns the locking members to the to him known proper angular relations, closes the door or gate, grasps knob 22 to slide bolt 11 to the right as seen in FIG. 1 until member 22 engages the end of housing 10, rotates the bolt clockwise as seen in FIG. 5 until the pins enter slots 31, and resets one or more of members 36. Bolt 11 cannot now be rotated or displaced linerally, and the function of the assembly as a combination lock is accomplished. Unlocking is of course accomplished by a reverse procedure.

The invention has a further feature which makes it possible to alter the combination of the lock at the user's pleasure. Locking members 36 are not solid, but are made up of an outer or overt portion 53 and an inner or covert portion 54. Portion 53 includes slots 44 and 45, O-ring 43, and groove 50. It is provided with an axial bore 55 and with crossbores 56 extending outwardly at locations spaced angularly by ninety degrees around the axis of the member, and aligned with grooves 44 and 45, but all at the same position longitudinally of the members. Portion 54 includes head 42 with ramp 46, but is also reduced in diameter at a shank 57 to fit rotatably in axial bore 55. Shank 57 also has a crossbore 60 to receive a ball detent 61 including a ball 62 and a spring 63. Crossbores 60 are conveniently directed in the same angular direction as ramps 46. Ball 62 may thus fall into any one of crossbores 56, which are sized to partially receive the balls. Spring 63 applies sufficient force to ball 62 to insure that under ordinary conditions rotation of outer portion 53 results in like rotation of inner portion 54. However means are provided for temporarily securing portions 54 against rotation in the housing, and then force applied through slots 44 and 45 may overcome the action of the ball detents to change the angular relation between slot 44 and ramp 46, thus resetting the combination of the lock. This resetting means will now be described.

In each portion 54 stem 57 is joined to head 42 by an annular shoulder 64. A groove 65 is cut secant-wise across this shoulder in one of four positions, either parallel to or normal to the axis of crossbore 60. The four different positions are chosen to introduce further randomity into the structures, no two of the locking members 36 being necessarily the same, or necessarily different. When the locking members are inserted into casing 12 there is a rotated position for each in which the grooves 65 for all are aligned. The bottoms of the grooves are slightly below the surface of plate 26, so a shallow groove 66 is cut on the upper surface of plate 26, and an overlay strip 67 secured to plate 26 and extending between apertures 30 is provided with a matching groove 70 on its under surfaces.

Figure 6:
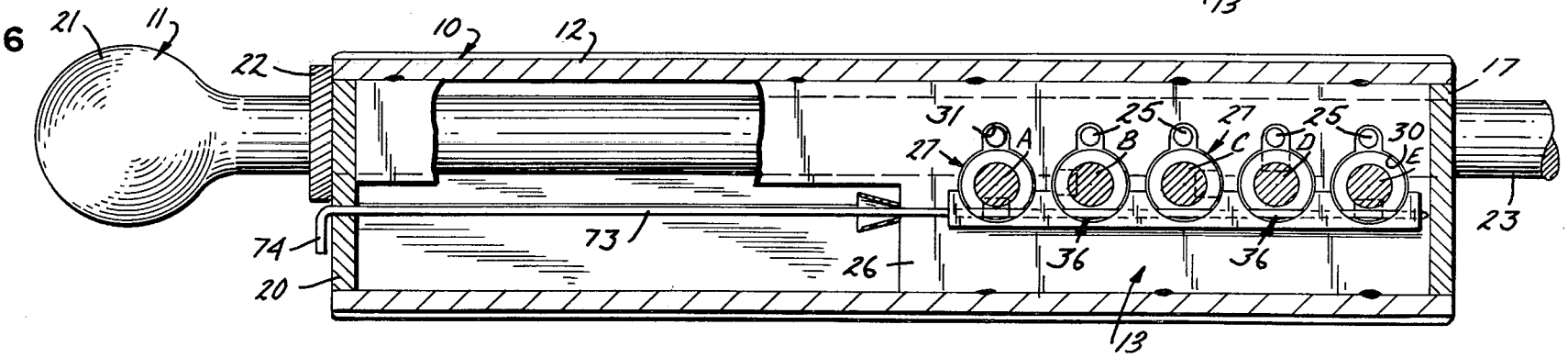
FIG. 6 is a view similar to FIG. 5, but showing how the combination of the lock may be changed.
Figure 2:
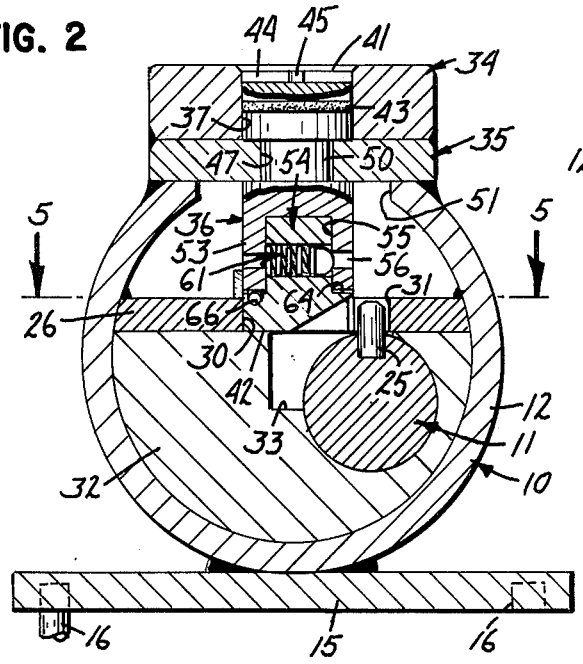
FIG. 2 shows a transverse section along the line 2—2 of FIG. 1.

An aperture 71 is formed in end closure 20 in line with the grooves 65, 66 and 70. For the construction shown, where plate 26 does not extend all of the way to end closure 20, a funnel member 72 is provided at the end of groove 66. A removeable member, in the form of a slender rod 73 having a right angle bend 74 or loop at its outer end, may be inserted through aperture 71 and fed through funnel member 72, grooves 66 and 70, and grooves 65. Note that aligning the lock members to pass member 72 does not of itself set the lock to release the bolt, as is clearly shown in FIG. 6. It does however establish a basic relationship of ramps 46 to pins 25, which is constant for a particular control unit but may vary from unit to unit in accordance with the locations of grooves 65 on shoulder 74 of particular lock members 36. By way of example, in positions A and E of FIG. 6 the ramp is one hundred-eighty degrees from the pin: in position B the ramp is ninety degrees counterclockwise from the pin, in position C the ramp is ninety degrees clockwise from the pin, and in position D the ram is in line with the pin. Now if all the slots 45 are adjusted to indices "1" on plate 34, by applying an appropriate instrument to the setting slots and overcoming the ball detents, and member 72 is removed, the proper "combination" for releasing bolt 11, reading the positions from left to right, will be 3-4-2-1-3. To change the combination, the basic condition is re-established, using member 73, and slots 45 are set to different initial positions, to result in a different release "combination" when member 72 is removed.

Ordinarily members 36 are free to rotate in plates 13 and 26 regardless of whether bar 11 is locked or is free to slide. If, while the bolt is in locked position, a meddling intruder applies torque to knob 21 so that pins 25 press against heads 42, force then applied to slots 44-45 may overpower ball detent 61 and thus make an unauthorized change in the combination. This will be detected when the lock fails to open to the correct combination, but does not require destruction of the lock. The user simply inserts member 72 as before, turning the locking members in succession until member 72 is fully inserted, and then resets the members to result in the previously set combination, or in a new combination if desired.

From the foregoing it will be apparent that I have invented a combination lock for use with closures where strength and security are significant. The lock is extremely rugged, extremely resistant to tampering, and capable of being reset to new combinations at the option of the user. The invention involves a new principle in which a bolt is slideable into and out of an operative position, and in that position is rotatable on its axis into a locked position, in which it is held by one or more of a plurality of locking members each rotatable about an axis orthogonal to the axis of the bolt and having a rotated position in which it enables the rotation of the bolt, all other positions of the locking members preventing such rotation, and the locking members being bipartite to permit relative rotation between an inner, covert portion and an outer, overt portion for changing the combination of the lock, means also being provided for holding all the inner portions in a basic position while the combination is being changed, or re-established upon meddling interference.

It will also be apparent that my structure can be used as a simple latch, if this is desired, without the user's thereby becoming aware of the combination of the lock. It is only necessary, after the lock is open and the bolt is moved from locked to operative position, to reset one or more of the locking members out of the positions which permitted unlocking of the bolt. The latter can now be slid back and forth to operate as a simple latch, although it cannot be moved into the locking position, and anyone unlatching the bolt will have no indication of what the combination of the lock may be.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. In a lock:

an elongated housing including end closures and a lateral wall;

a bolt extending through said end closures and carried thereby for rotation in first and second opposite senses about a longitudinal axis, and for linear displacement in first and second opposite directions aligned with said axis;

means carried by one end of said bolt outside said housing for manually causing the displacement and rotation of said bolt, and for engaging one of said end closures, and thus limiting the linear movement of said bolt in a first direction, to define an operative position for said bolt in which the other end of said bolt extends outwardly beyond the opposite end closure;

at least one pin projecting transversely from said bolt within said housing;

means in said housing for engaging said pin to limit the rotation of said bolt in said first sense;

means in said housing for engaging said pin in said operative position of said bolt to enable limited rotation of said bolt in said second sense and simultaneously prevent displacement of said bolt in either direction;

and a control unit including at least one locking member carried by said housing and transversely aligned with said pin for actuation into and out of a position in which it interferes with said pin to prevent rotation of said bolt in said first sense;

said locking member extending through the wall of said housing and being rotatable with respect thereto about a locking axis orthogonal with the axis of rotation of said bolt and longitudinally aligned with the pin location when said bolt is in said operative position thereof;

the outer end of said locking member including means for causing rotation thereof in said housing, and bearing indicia identifying the rotated relation of said member with respect to said housing, and the inner end of said locking member being configured to enable passage of said pin, in a first rotated relation of said member with respect to said housing, and to prevent passage of said pin in other rotated relations of said member with respect to said housing.

2. The structure of claim 1 in which said locking member comprises an outer, overt portion and an inner, covert portion, said portions being relatively rotatable about an axis common thereto, and resilient means releasably opposing relative rotation between said portions in each of a plurality of selected relative rotated positions thereof.

3. The structure of claim 2 together with means for fixing the rotated position of said inner portion with respect to said housing while said outer portion is rotated with respect thereto by overcoming said resilient means.

4. A lock control unit comprising a mounting plate having a plurality of aligned cylindrical bores formed therein with their axes parallel;

a plurality of locking members having outer cylindrical portions for rotation in said bores, inner portions, and intermediate annular grooves of smaller diameter than said outer and inner portions;

a holding member for securing said locking members to said mounting plate, including a slot to snugly receive said grooves of said members, so that when the holding member is secured against a face of said mounting plate with said outer ends of said members in said bores and said grooves in the slot of said holding means, the members are rotatable but not translatable with respect to said plate;

axial cylindrical bores in said inner ends of said outer portions of said locking members;

cross bores extending outwardly from said cylindrical bores at predetermined angular spacings therearound, and at the same axial location therealong;

said inner portions including bodies rotatable in said axial bores, ball detents in said bodies and aligned longitudinally with said cross bores, and enlarged heads extending beyond said bores;

release ramps formed in said heads of said inner portions in known positional relation to the directions of said ball detents;

secantal guide openings in said heads of said inner portions arranged to be coaxial when said inner portions are simultaneously in predetermined angular positions about the axes of said bores, so that a common member passing through said openings may hold all said inner portions against rotation about said axes;

and means carried by the outer ends of said locking members for causing rotation thereof in said bores.

* * * * *